US007270269B2

(12) United States Patent
Iyer et al.

(10) Patent No.: US 7,270,269 B2
(45) Date of Patent: Sep. 18, 2007

(54) SECURE ELECTRONIC VOTING DEVICE

(75) Inventors: Subramanian S. Iyer, Mount Kisco, NY (US); Gregory J. Fredeman, Wappingers Falls, NY (US); Chandrasekharan Kothandaraman, Hopewell Junction, NY (US); Alan Leslie, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 14 days.

(21) Appl. No.: 11/162,306

(22) Filed: Sep. 6, 2005

(65) Prior Publication Data

US 2007/0051805 A1 Mar. 8, 2007

(51) Int. Cl.
*G07C 13/00* (2006.01)

(52) U.S. Cl. ..... 235/386; 235/51; 235/56; 235/50 R; 235/50 A; 235/50 B; 705/12

(58) Field of Classification Search ..... 235/386, 235/51, 56, 50 R, 50 A, 50 B, 52, 55; 705/12
See application file for complete search history.

(56) References Cited

U.S. PATENT DOCUMENTS 4,641,240 A * 2/1987 Boram ..... 705/12
6,008,523 A 12/1999 Narayan et al.
6,432,760 B1 8/2002 Kothandaraman et al.
6,433,404 B1 8/2002 Iyer et al.
6,624,499 B2 9/2003 Kothandaraman et al.
6,642,601 B2 11/2003 Marshall et al.
6,799,723 B2 * 10/2004 Kotob et al. ..... 235/386
2004/0046021 A1 * 3/2004 Chung ..... 235/386
2006/0196939 A1 * 9/2006 Kim et al. ..... 235/386

OTHER PUBLICATIONS

Pending IBM Application entitled, "Programmable Semiconductor Device", U.S. Appl. No. 10/904,058, Kothandaraman et al., Oct. 21, 2004.
Pending IBM Application entitled, "Secure Voting System", U.S. Appl. No. 11/162,297, Anderson et al., Sep. 6, 2005.

* cited by examiner

*Primary Examiner*—Michael G. Lee
*Assistant Examiner*—Kristy A. Haupt
(74) *Attorney, Agent, or Firm*—Rosa S. Yaghmour; Howard Cohn

(57) ABSTRACT

A secure device for electronic voting employs a write-once vote-recording medium. The medium has an initial writing mode in which data can be written but not read and a subsequent reading mode whereby data can be read but writing is permanently disabled. Once switched from the writing mode to the reading mode, it cannot be switched back. A hardware mechanism provides successful write confirmation The medium can be installed like a cartridge into a vote-recording device. The voting device provides encryption/authorization that combines polling parameters with voter information to produce a "fuse string". For each vote, a fuse string is written to the array. The poll is "closed" by switching the medium to "read" mode, preventing further modification or tampering. To read out the results of the poll, an auditor enters "password" information to decode/decrypt the recorded information.

15 Claims, 3 Drawing Sheets

SECURE ELECTRONIC VOTING DEVICE

TECHNICAL FIELD

The present invention relates to voting devices, and more particularly to devices for registering votes (ballots) electronically.

BACKGROUND OF THE INVENTION

Voting machines are well known, and have been in use for over a century in the United States. Such machines are intended to speed the vote counting process and to eliminate a variety of problems inherent in voting by paper ballot. For all but the smallest of elections and/or ballot initiatives, the process of collecting, counting and tabulating paper ballots has proven to be tedious, time-consuming, error-prone and subject to a variety of tampering schemes. The use of voting machines has helped to speed the process of vote counting, but these machines often suffer from a variety of shortcomings. For example, simple mechanical lever voting machines of various types have been in use in parts of the United States since 1892. Voters pull levers corresponding to the candidates for whom they wish to cast a vote. In a typical machine of this type, the voter can pull levers, view the levers to consider the choices he/she has made, and make changes to those choices until he/she finalizes his/her vote by pulling a special lever that simultaneously enters the voter's selections into the machine's totals and moves all of the voting levers back into their unselected position. Pulling the special lever causes counter wheels inside the machine to rotate, adding the voter's selections to selections already made by other voters. At the end of an election, election officials open up each voting machine to read the totals from the counter wheels and determine how many votes were cast for each candidate. By the 1960s, about half of all votes in the United States were cast on such mechanical voting machines. These machines were appealing to election officials and voters alike because they allowed election results to be determined quickly, and because they were able to thwart voting fraud schemes that had become widespread using paper ballots.

However, most voting machines—from the earliest mechanical machines to the latest, high-tech electronic voting machines suffer from any of a variety of shortcomings. One of the main disadvantages of the simple lever machines is that they maintain no record of the individual votes cast—they store only totals on a per-candidate basis. As a result, it is not possible to audit them or to "recount" individual ballots. If the machine malfunctions and a counter wheel fails to record totals properly, there is no record from which a corrected tally can be determined. Lever machines do not completely eliminate election fraud, either. Occasionally, levers are mislabeled (either accidentally or deliberately). Because of their size and weight, these machines are expensive to store and transport. Despite the fact that lever machines were still in use in some 15% of all counties in the US, these machines are no longer manufactured, making it difficult or impossible to obtain spare parts.

Devices for electronic voting and/or electronic vote counting are well known, and have featured prominently in recent state and national elections. Some examples are optically scanned paper ballots, machine-read punched cards and direct-recording electronic devices. Each type has its own advantages and disadvantages.

Perhaps the most infamous of these voting systems is the electronically-counted punched card system used in many states in the 2000 Presidential election—perhaps most notably in Florida. Incomplete punching left many cards only "dimpled" or partially perforated, and a variety of other problems resulted in many complaints of improperly recorded vote totals. Because these punched cards were counted by electronic means (typically by optical scanning or by sense wires in punched-card readers), improperly or partially perforated cards could register incorrectly. Although the absolute numbers of ballots in question was relatively small, their significance was greatly magnified due to the closeness of the election.

Optically scanned (mark-sense) ballots, similar to those used in college entrance exams (SAT, LSAT, MCAT, etc.) tend to be less problematic, but are still capable of misregistering votes, especially when a vote is changed by erasure. They are also highly vulnerable to tampering.

Some of the biggest concerns associated with electronic voting (and automated voting systems in general) are as follows.

Physical security: Electronic voting machines are relatively small and easy to transport. While this may represent a significant cost savings to local election authorities, the portability of such devices makes them relatively easy to steal and manipulate.

Vote Tampering: Tampering with votes is one of the greatest concerns to election officials and voters alike. Although actual incidents of vote tampering may be relatively rare, the implications of successful vote tampering are enormous, especially if the practice becomes widespread.

Unauthorized Voters: When votes from unauthorized voters are successfully recorded, the impact is not unlike that of vote tampering, where the outcome of an election can be affected.

Multiple Votes: Another concern in election systems is the prevention of multiple votes by the same individual. If such a practice is ignored and becomes widespread, the outcomes of elections can be affected.

Overvotes/Undervotes (intentional or unintentional): An "overvote" occurs when a voter casts a vote for more candidate than he/she is permitted. An "undervote" occurs when a voter fails to enter a selection where one is permitted/expected. Most fully-automated electronic voting systems are programmed to notify the voter that an undervote or overvote has occurred and will not permit the vote to be entered until the problem is corrected. Occasionally, however, programming errors occur and overvotes/undervotes are recorded, possibly misrepresenting the voter's intention. On paper ballot systems, an improperly filled out from may cause the ballot counting device (e.g., optical scanning system) to reject the ballot, effectively negating that ballot. Even worse, a programming error could cause valid ballots to be rejected while improperly filled-out ballots are recorded. Although rare, such situations have occurred in the past.

"Escrow" votes: A relatively new concept is a situation where one or more ballots are held in "escrow" while the eligibility of a certain category of voters is contested. In at least one recent case, such voters were allowed to cast their ballots, but their votes were withheld from the vote totals until the eligibility issue was resolved.

Access to voter information: In the US and in most countries, voting is by secret ballot. This is because of concern over the possibility of coercion of voters or "sale" of votes. In a secret ballot, there is no way to know how any one voter cast his/her ballot, frustrating coercion and leaving voters with no record of their ballot to exchange for payment.

Interpretation Problems: On some ballots, there are rules as to how the ballot is to be cast. For example, in some elections there are multiple seats available, with more candidates to select from than there are seats. The rules of the election may permit voters to select only a specific number of candidates. Depending upon the complexity of the rules and the clarity of the voter instructions, such ballot choices can be confusing, leading to significant questions of interpretation when tallying vote totals.

Audit Trail: Many states require a "recount" in the event of a close vote. However, some voting systems (e.g., the well known lever system) provide no effective means for recounting, because there is no audit trail of individual votes from which to reconstruct the vote totals. However, there is great concern over the nature of the audit trail information. If a ballot is traceable back to an individual voter, then ballot secrecy is destroyed. Audit trail systems must be carefully constructed to reproduce the individual voter's selections without directly identifying the voter.

In fully electronic systems, the validity of an electronically recorded audit trail is the subject of considerable debate, since the recording media can be altered and in the event of a voting system failure, there may be no way to guarantee the integrity of the electronic audit record. Unless a system can be demonstrated to provide a virtually flawless audit record (even in the event of a system failure), lack of confidence in the validity of audit trail information can render such a system useless.

One of the biggest problems with electronic voting systems is their dependence upon conventional electronic recording media. While strong encryption mechanisms may be able to prevent "snooping" and may effectively control access to election data, it may not be possible to prevent damage to the vote recording media and/or audit record. In response to this, some electronic voting systems provide an option for a paper record of each ballot cast. Presumably, this addresses some of the audit trail concerns, but implementation of this scheme requires election officials to maintain two complete sets of records: one on paper and one on electronic media. In the event of a discrepancy, it is difficult to determine which record is correct. Further, the possibility of destruction, loss or defacing of the paper record raises many of the old concerns about paper ballot tampering.

ASPECTS AND SUMMARY OF THE INVENTION

It is therefore an aspect of the present invention to provide a secure electronic voting device that provides tamper-proof ballot recording.

It is a further aspect of the present invention to provide a secure electronic voting device with an inherently reliable and unalterable electronic audit trail.

It is a further aspect of the present invention to provide a secure electronic voting device that maintains ballot secrecy.

It is a further aspect of the present invention to provide a secure electronic voting device that prevents alteration and/or reading by unauthorized individuals.

It is a further aspect of the present invention to provide a vote-recording medium that is unalterable after the close of voting.

It is a further aspect of the present invention to provide a vote-recording medium that is unreadable while voting is in progress.

According to the invention, a secure device for electronic voting is employs a write-once vote-recording cartridge, preferably based on an e-fuse array. The cartridge has two distinct modes of operation: write mode and read mode. When in write mode, the array can only be written—it cannot be read. When in read mode, the array can only be read—it cannot be written.

When initially enabled by poll office workers, the array starts out in its write mode. This enables vote recording onto the array. At the close of voting (or when the cartridge becomes "full") the cartridge is switched to read mode. Once switched into read mode, it cannot be switched back to write mode. Data recorded into the array is encrypted so that only authorized poll auditing officials can read the array by decrypting the contents thereof via an appropriate encryption key. Each vote is recorded in its entirety, preferably along with voter eligibility information, thereby providing a highly secure, unalterable electronic audit trail of all votes recorded into the array.

A hardware mechanism within the cartridge provides confirmation of successful writing. The e-fuse array is installed (like a cartridge) into a vote-recording device. The voting device has an encryption/authorization mechanism that combines polling parameters (entered by the polling authority) with user (voter) information (Voter ID confirmation, poll selections, etc.) to produce a "fuse string" to be written into the e-fuse array. Upon completion of each vote, the fuse string from is written to the array, with hardware confirmation of successful writing. When all polling is complete, the poll is "closed" by switching the e-fuse array to the "read" mode, which permanently disables any further modification of the array. The encryption used to generate the "fuse string" values for each voter (user) renders the e-fuse contents meaningless to anyone except an auditor with proper authorization. In order to read out the results of the poll, an auditor must enter "password" information to decode/decrypt the contents of the e-fuse array.

A typical secure device for electronic voting, according to the present inventive technique, comprises a write-once vote recording medium, means for verifying a poll office user's credentials, means for verifying voter eligibility, means for entering vote selections, means for generating a fuse string from the voter's selections and voter eligibility information, means for storing the fuse string into the vote recording medium, means for enabling the vote recording medium into an initial writing mode, means for switching said vote recording medium from a writing mode to a reading mode, means for verifying auditor credentials, and means for reading the vote recording medium.

Poll workers initially enable the device by providing "credentials" (encrypted password information) that allows them to "unlock" or enable the recording medium within the device for writing. Voters "sign on" to the machine using voter eligibility information (another form of key) to confirm their eligibility to vote. Via a user interface, the voter make his/her ballot choices, then "finishes" voting, at which point the selections are combined with the voter eligibility information and encrypted into a "fuse string" to be written into the recording medium.

When all voting is complete, the poll workers "close" the recording medium (after once again providing valid "credentials"), which switches the recording medium from its writing mode to its reading mode. Once this is done, the device cannot be written or altered. The encrypted fuse strings prevent access to ballot information by unauthorized individuals. Auditing officials (who may also be poll workers) then sign onto the device by providing auditing credentials (encrypted password information) that lets them decode the contents of the recording medium. Application software within the device reads and totals the individual votes. In the event that a recount is required, the individual votes and their associated eligibility information can be retrieved for manual and/or automated re-confirmation of the vote totals.

Preferably, the vote recording medium is a removable fuse bay cartridge device based on e-fuse technology. The fuse bay cartridge stores information into an array of e-fuse elements embedded therein. E-fuse elements are inherently write-once devices, and once written, cannot be erased.

A typical fuse bay cartridge would comprise a write-once array of e-fuse elements and means for switching from an initial writing mode to a reading mode. In the writing mode, e-fuse elements can be written, but not read. In the reading mode, e-fuse elements can be read, but not written. Once the fuse bay cartridge device is switched from the writing mode to the reading mode, it cannot be switched back to writing mode.

Preferably, the vote recording medium includes a unique Device ID stored therein. Authorization and access to the medium would be encrypted according to this device ID. No other cartridge (medium) would have the same ID.

According to an aspect of the invention, the auditing and vote recording functions can be physically separated from one another such that vote recording (voting) occurs on one special-purpose station, while vote tabulating/auditing occurs at a different, special purpose station. This has the added benefit of preventing a stolen voting machine from being used to read polling data. The vote recording device (station) can only be used to enter voting information, and only when properly authorized by poll office workers. The vote tabulating/auditing device can only be used for reading the voting medium (and only when properly authorized). It cannot be used to enter votes.

BRIEF DESCRIPTION OF THE DRAWINGS

These and further features of the present invention will be apparent with reference to the following description and drawing, wherein.

DETAILED DESCRIPTION OF THE INVENTION

Figure 1:
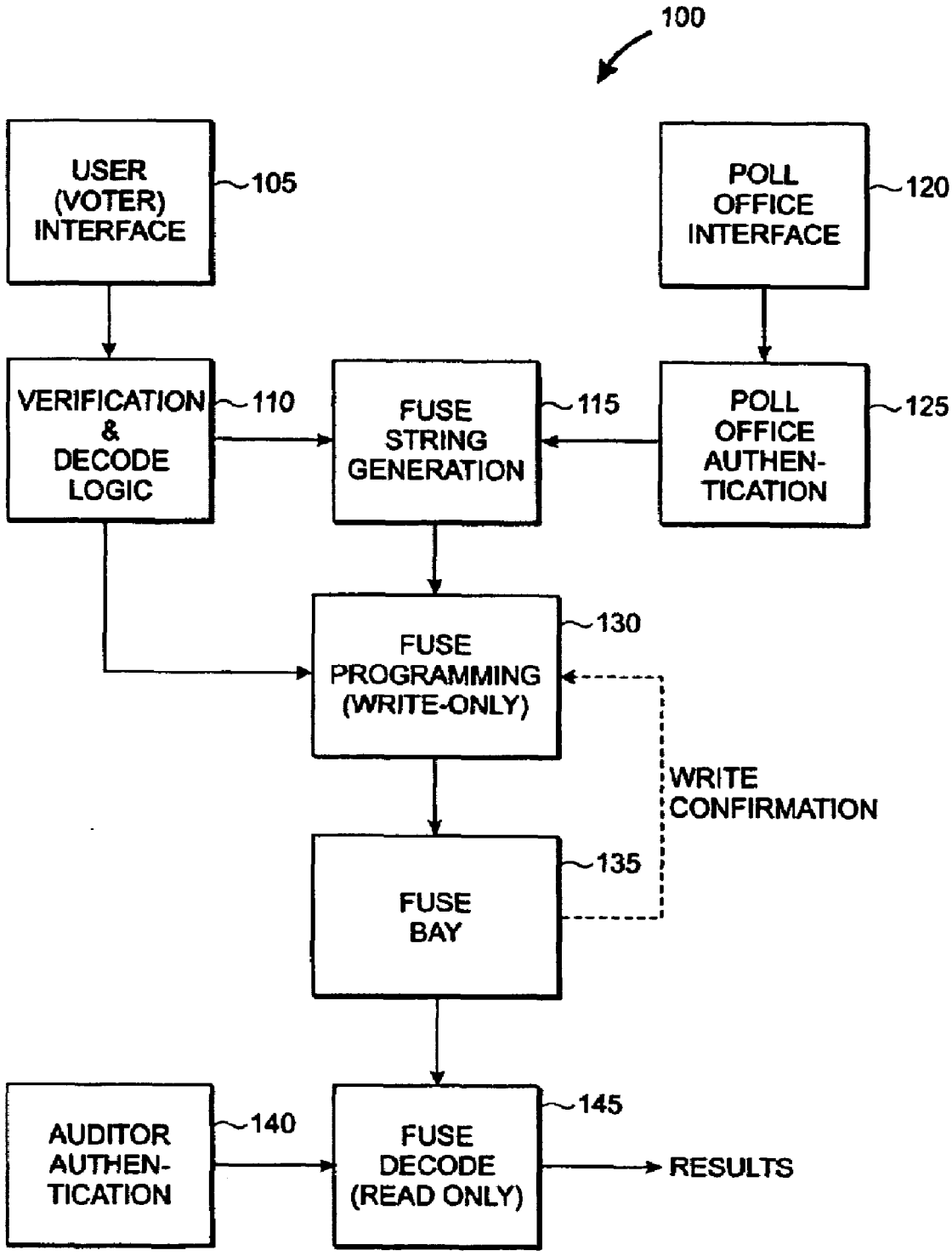
FIG. 1 is a block diagram of a secure device for electronic voting, in accordance with the invention.

According to the invention, a write-once vote recording medium is employed to record individual votes, providing both an audit trail and a record of vote totals. This write-once memory has several characteristics that make it uniquely suited for recording of vote information. Specifically, the vote recording medium:

- acts as a write-once memory, which once programmed cannot be altered.
- has two distinct modes of operation, "write mode" and "read mode"
- when in "write mode", the medium cannot be read
- when in "read mode", the medium cannot be written
- once switched into "read mode" the medium cannot be switched back into "write mode"

Preferably, the vote recording medium is an e-fuse array (similar in nature to older "fusible-link" PROMs). Also, the vote recording medium preferably embodies a hardware confirmation mechanism for verifying that a requested write operation was successfully and accurately executed. This confirmation mechanism provides write verification without providing read-back capability, thereby enhancing reliability without sacrificing data security. Like a conventional fuse, an e-fuse can be "blown" to change its state from high-conductivity (low resistance) to low-conductivity (high resistance), but once "blown", the e-fuse cannot be restored. As an element of a larger array of e-fuses, this creates a memory with inherent write once characteristic that does not rely on software or other "soft" logical locking mechanisms to prevent re-writing. Once written, ("blown") the e-fuse simply cannot be altered back to its previous low-resistance state; an inherent property of e-fuses.

U.S. Pat. Nos. 6,008,523, 6,432,760, 6,433,404 and 6,624,499 discuss various aspects of an eFuse, relevant to the present invention. The patents are assigned to the assignee of the present application, and are incorporated in their entirety herein. U.S. Pat. No. 6,642,601 teaches a specific eFuse improvement, and in particular teaches the use of thinner layers in the fuse link regions as compared to the rest of the fuse. The disadvantage of this eFuse ('601) is that in order to create such a structure, additional process steps including mask levels and lithographic processes are required.

One suitable "e-fuse" memory structure is described in U.S. Pat. No. 6,624,499 ('499), "System for Programming Fuse Structure by Electromigration of Silicide Enhanced by Creating Temperature Gradient", issued on Sep. 23, 2003 to Kothandaraman et al., (hereinafter '499), incorporated herein by reference in its entirety. The '499 patent describes an e-Fuse programmable by electromigration of silicide, said electromigration propelled by creating a thermal gradient across the e-fuse. This provides an extremely clean "blow" of the fuse as compared to earlier fusible devices that relied upon vaporization of their fusible link. The process of vaporization tended to "spatter" fuse material over a considerable area surrounding the e-fuse, limiting e-fuse density. By providing a much cleaner, low "spatter" fuse blowing mechanism, much higher e-fuse density can be achieved.

Another suitable e-fuse mechanism is described in commonly-owned, co-pending U.S. patent application Ser. No. 10/904,058 entitled "Programmable Semiconductor Device" whereby an e-Fuse device is altered (programmed) from a relatively low-resistance state to a relatively high-resistance state by flowing an electrical current through a fuse having a metallic material such as a semiconductor alloy disposed on a doped semiconductor line, for a time period such that a portion of the semiconductor alloy migrates from a first end of the device to a location proximate to a second end of the device, resulting in a high final resistance.

FIG. 1 is a block diagram of a secure device 100 for electronic voting, wherein a suitably adapted fuse bay 135 acts as a vote recording medium. Preferably, the fuse bay 135 is a replaceable e-fuse "cartridge" which is replaced for each new election and/or when the "cartridge" becomes full. The Full/Not Full status of the fuse bay can be determined by counting down the known capacity of the fuse by the amount of vote data written to it. Alternatively, the fuse bay can be provided with a separate capacity status monitor mechanism.

Election officials "enable" the voting device 100 for vote recording via a poll office interface 120. A poll office authentication function 125 verifies credentials of a poll office user, ensuring that only a properly credentialed election authority has control of the device 100. This can be accomplished via encryption keys or any other suitable means. Upon authentication, the voting device is enabled for writing. In this state, the fuse bay can be written, but cannot be read.

Voters interact with a user interface 105 (e.g., a suitably programmed touch-screen display system or other suitable means of interacting with the voting device 100). Each voter enters eligibility information via any suitable mechanism; (e.g., manual PIN entry, magnetic card, smart card, biometric, etc.) for verification by verification and decode logic 110. This eligibility information is recorded along with the vote. It is not traceable back to the voter, but is traceable back to the system that generated it. It merely indicates that the voter's ID has been checked and that the voter is eligible to vote. The eligibility information can also include "class of eligibility" information, so that "provisional" votes entered by certain contested classes of voters can be held "in escrow" while questions related to the eligibility of those voters are resolved.

When voter eligibility (or provisional eligibility) is confirmed by verification decode logic 110, the voters selections (made via the same user interface 105) are passed to a fuse string generation function 115, which generates an encrypted string encoding the voter's eligibility information and ballot selection(s), for programming into the fuse bay 135 by a fuse programming function 130. The fuse programming function ensures that the fuse string is successfully programmed into the fuse bay 135 by monitoring a write confirmation signal returned by the fuse bay 135. In the event of a failure, a suitable alert mechanism can be activated (e.g., light, alarm, network message, etc.) and/or corrective action can be taken. The write confirmation mechanism only provides confirmation of successful writing, but does not read back any data from the fuse bay 135.

When voting is completed (or when the fuse bay 135 is full), the election authority "closes" the voting device 100 by switching the mode of the fuse bay 135 from "write mode" to "read mode". Once switched, no further writing of the fuse bay 135 is possible. If the fuse bay is full, election officials can remove it, replace it with another cartridge and enable the new cartridge via the poll office interface. Generally, the eFUSE device size is sufficiently small that a single cartridge should be able to accommodate the entire voting population of an individual polling center. Alternatively, the read machine may accept multiple cartridges that are individually enabled on demand after appropriate authentication.

Upon completion of polling, the fuse bay 135 totals can be read out by means of an auditor interface where by an auditor authentication function verifies an auditors credentials (e.g., password, encryption key, etc.) and permits access to data stored in the fuse bay 135. Decoding of fuse strings stored into the fuse bay requires successful decryption of those strings, thereby preventing unauthorized access to ballot information. When successfully decoded, the fuse bay data is provided at an output (RESULTS). The result information can be fed directly into an electronic vote tabulating system, displayed on a suitable user interface, etc . . .

In the event of a write failure, it is possible to take corrective action so that voting is not disrupted. A write failure could occur if there is a malformed e-fuse device in the fuse bay. Although certain levels of e-fuse reliability can be assured by design and by testing, it may not be possible to provide positive assurance that any given e-fuse will "blow" reliably without actually blowing the e-fuse. Accordingly, a suitable failure recovery mechanism is in order.

Many different write failure recovery mechanisms are possible. One mechanism is to provide redundant fuse bays, whereby identical votes are recorded in multiple cartridges. In the event of a write failure in one device, the election authority can rely on redundancy to guarantee integrity of the record (e.g., if two devices agree and one doesn't, the two devices that agree are correct). Preferably, each fuse string will contain a checksum or ECC (Error Correction and Checking) tag to further enhance reliability.

Another simple error recovery mechanism doesn't require redundant cartridges. Upon detecting an unrecoverable error (i.e., write verification indicates that the fuse string was not successfully recorded and that ECC mechanisms cannot recover it) the string is re-written in a subsequent record position in the fuse bay along with a duplicate record marker indicating that the previous record (if it exists) is to be ignored. Where duplicate record markers are found, accept only the last-written one corresponding to any given vote. The polling authority is alerted to the failure (visible/audible indication, network notification, etc) and the number in sequence (i.e., the number of votes recorded) is noted via a non e-fuse mechanism for audit comparison purposes.

Another simple mechanism, is to "stomp" the failed record (blow ALL of the fuses associated with the string, thereby completely obliterating it) then to re-write the string in a new location. Treat the "most fuses blown" condition as invalid data. The polling authority is alerted to the failure (visible/audible indication, network notification, etc).

Figure 2:
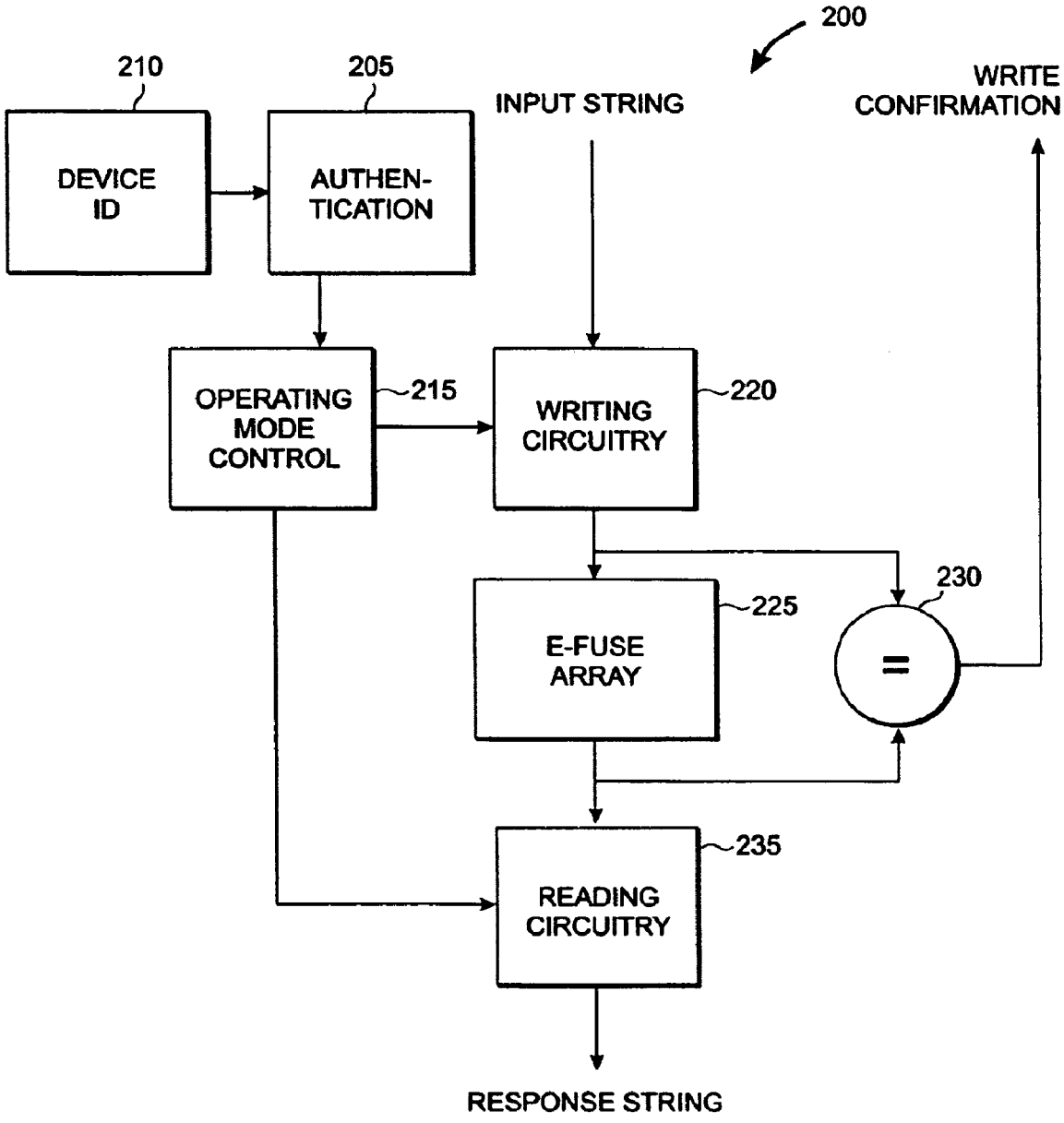
FIG. 2 is a block diagram of a secure write-once vote-recording medium for electronic voting, in accordance with the invention.

FIG. 2 is a block diagram of a secure write-once vote-recording medium 200 (fuse bay device) for electronic voting. This device 200 comprises an authentication function 205 for verifying authorization to enable the device 200 and/or to change modes, a unique Device ID number 210, an operating mode control function 215, writing circuitry 220, an e-fuse array 225, a write verification comparator 230 and reading circuitry 235.

Preferably, the authentication function 205 compares polling authority/audit authority information with a unique Device ID 210 programmed into the device 200 using an encryption mechanism. Information is provided with the fuse bay device that will permit the polling authority to enable and/or change the operating mode of the device 200. Preferably, this information is provided in the form of an encryption key, which when combined with the Device ID and the polling authority's identifying information will confirm the polling authority's authorization to control the device 200. No two fuse bay devices have the same Device ID 210.

Once enabled, fuse strings (INPUT STRING) provided to the writing circuitry 220 will be recorded into the e-fuse array. The data written into the e-fuse array is compared to the intended data to be written and if they match, the write verification comparator 230 generates a write confirmation signal. If they do not match, a write failure is indicated.

When the polling authority switches the operating mode of the device 200 to the "read mode", the auditing authority can read out the stored vote data via the reading circuitry 235 after verifying its authorization to do so via the authentication function 205.

Figure 3A:
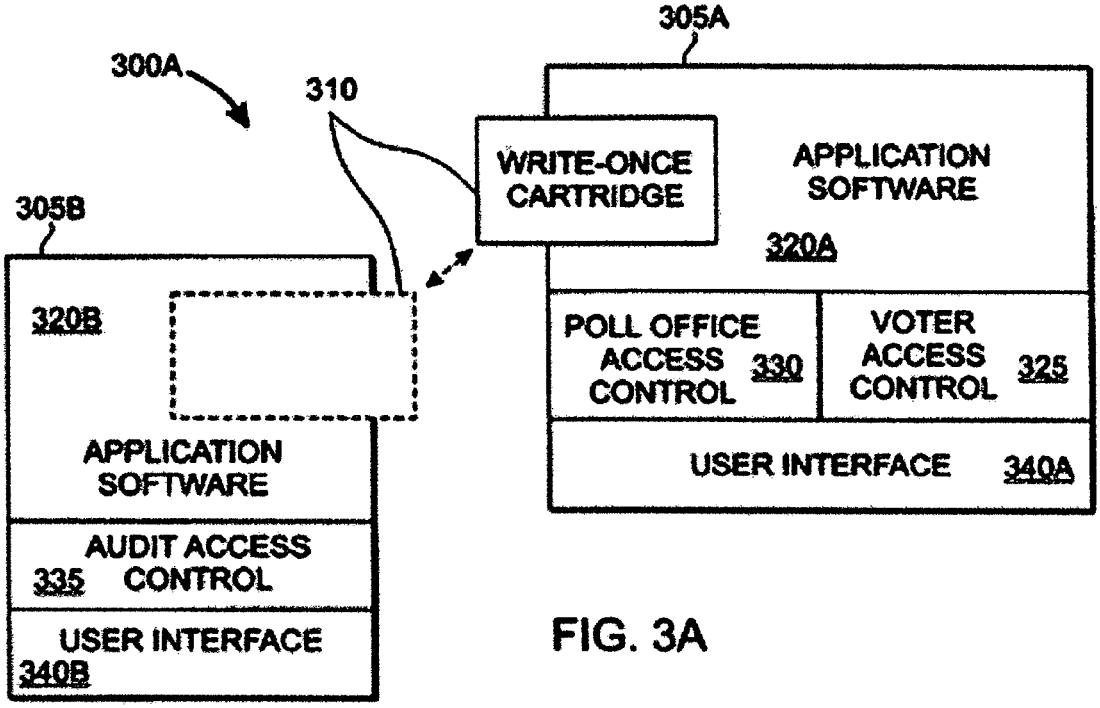
FIG. 3A is a block diagram of one embodiment of a system for secure electronic voting, in accordance with the invention.

The discussion hereinabove with respect to FIG. 1 describes a single system whereby the polling authority, voter, and auditing authority all access the fuse bay "cartridge" device. FIG. 3A is a block diagram of one embodiment of a system 300A for secure electronic voting wherein two separate devices 305A and 305B are used for voting and for auditing. The system 300A comprises a vote recording device 305A and a vote tabulating/auditing device 305B. The vote recording device 305A includes a user interface 340A, voter access control function 325, a poll office access control function 330, application software 320A, and means for receiving a write-once fuse bay cartridge 310, which can be moved between the vote recording device 305A and the vote tabulating/auditing device 305B (as indicated by a double headed arrow and dashed box). The vote tabulating/auditing device 305B includes a user interface 340B, audit access control function 335, application software 320B, and means for receiving the write-once fuse bay cartridge 310.

As in the scenario described hereinabove with respect to FIG. 1, the polling authority enables the fuse bay cartridge 310 installed in the vote recording device 305A by means of the user interface 340A and poll office access control function 330 (compare 125). The voter confirms eligibility and records his/her vote by means of the user interface 340A voter access control function 325 (compare 110). Application software 320A includes the various support functions (e.g., fuse string generation, programming, etc.) required to record votes and control the operating mode of the fuse bay cartridge 310.

The auditing authority (which may be the same as the polling authority), authenticates itself via the user interface 340B and audit access control function 335 in the vote tabulation/auditing device 305B. Upon gaining access to the fuse bay cartridge 310, the auditing authority can readout the contents thereof. Application software 320B manages the presentation of the data from the cartridge 310, presenting totals, detailed vote information, etc . . .

Although the system 300A comprises two separate devices, these devices provide additional security by ensuring that if a vote recording device is stolen, no information can be read out of any cartridge device because the vote recording device does not implement any auditing functions. Similarly, if a vote tabulating/auditing device is stolen, it is not possible to record votes onto a cartridge with it.

Figure 3B:
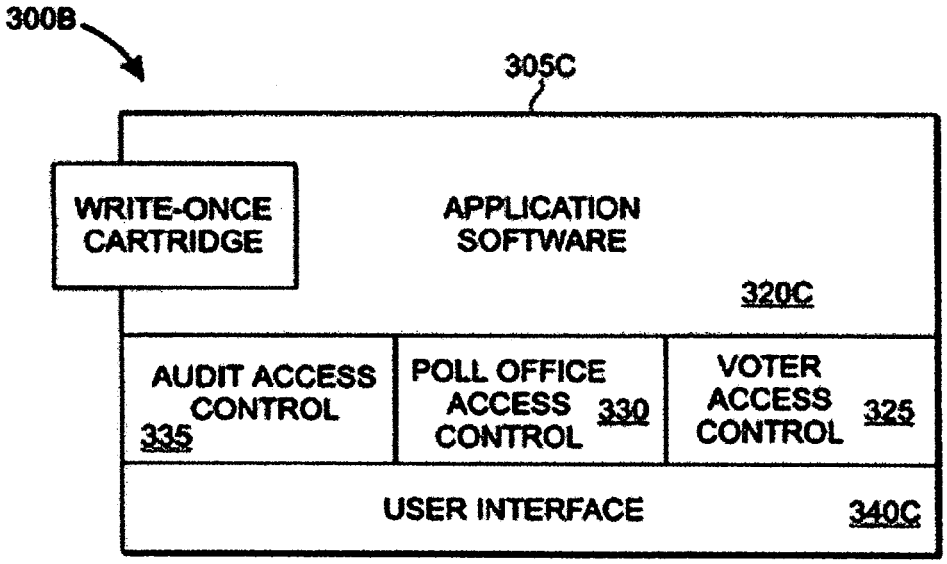
FIG. 3B is a block diagram of another embodiment of a system for secure electronic voting, in accordance with the invention.

FIG. 3B is a block diagram of an all-in-one system 300B for secure electronic voting, similar to that described hereinabove with respect to FIG. 1. The system 300B comprises a multi-function voting/tabulating/auditing station 305C which includes a user interface function 340C, audit access control function 335, poll office access control function 330, voter access control function 325, application software 320C and means for receiving a write-once fuse bay cartridge 310. The user interface function 340C essentially combines the functions of user interface 340A and 340B described hereinabove with respect to FIG. 3A. The audit access control function 335, poll office access control function 330 and voter access control function 325 are essentially identical to the corresponding functions described hereinabove with respect to FIG. 3B. The application software 320C combines the function of application software 320A and 320B.

In summary, the present inventive technique provides a secure device for electronic voting based upon a write-once vote-recording cartridge, preferably based on an e-fuse array. The cartridge has the following characteristics:

- two distinct modes of operation: write mode and read mode
- when in write mode, the array can only be written—it cannot be read
- when in read mode, the array can only be read—it cannot be written
- starts out in write mode
- once switched to read mode, it cannot be switched back
- hardware confirmation of successful writing The e-fuse array is installed (like a cartridge) into a vote-recording device (e.g. 305A, 305C, 100). In its initial, unprogrammed state, the e-fuse array is ready to be written when enabled (write mode—no reading is possible). The voting device has an encryption/authorization mechanism that combines polling parameters (entered by the polling authority) with user (voter) information (Voter ID confirmation, poll selections, etc.) to produce a "fuse string" to be written into the e-fuse array. Upon completion of voting, the fuse string from is written to the array, with hardware confirmation of successful writing.

When ALL polling is complete, the poll is "closed" by switching the e-fuse array to the "read" mode, which permanently disables any further modification of the array. The encryption used to generate the "fuse string" values for each voter (user) renders the e-fuse contents meaningless to anyone except an auditor with proper authorization. In order to read out the results of the poll, an auditor must enter "password" information to decode/decrypt the contents of the e-fuse array. Two possible scenarios are:

- the vote recording machine itself can be used for auditing purposes (FIGS. 1, 3B)
- the vote recording machine does not have readout capability. A separate auditing station must be used. (FIG. 3A)

Since the e-fuse array cannot be read while it is in "write" mode, it is necessary for other external mechanisms to verify that a voter has not yet voted. Automated coordination across voting machines requires some level of local networking. Automated coordination across multiple polling locations requires wide area networking. If the network or any part of it is down, such coordination is not possible, so contingency strategies are necessary.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described inventive components the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A write-once vote recording medium for electronic voting, comprising: an array of write-once e-fuse elements; writing circuitry; reading circuitry; operating mode control circuitry for switching said recording medium from an initial writing mode to a reading mode such that when in said initial writing mode, the writing circuitry is enabled and the reading circuitry is disabled to prevent reading of the array; and when in said reading mode the reading circuitry is enabled and the writing circuitry is permanently disabled to prevent further writing of the array; said reading and writing modes being mutually exclusive, and when switched from the initial writing mode to the reading mode, the mode cannot be switched back to the initial writing mode.

2. A device according to claim 1, further comprising write confirmation means for confirming successful writing of the array of e-fuse elements.

3. A device according to claim 2, wherein said write confirmation means is a comparator.

4. A device according to claim 3, further comprising authentication means for controlling access to said operating mode control circuitry.

5. A device according to claim 1, wherein said e-fuse elements are write-once fusible elements which, when written, change permanently from a relatively low-resistance first state to a relatively high-resistance second state.

6. A secure device for electronic voting, comprising:
- a write-once vote recording medium;
- means for verifying a poll office user's credentials;
- means for voter eligibility;
- means for entering vote selections,
- means for generating a fuse string from said vote selections and voter eligibility information;
- means for storing said fuse string into said vote recording medium;
- means for enabling said vote recording medium into a writing mode;
- means for switching said vote recording medium from a writing mode to a reading mode;
- means for verifying auditor credentials;
- and means for reading said vote recording medium; wherein:
- said write-once vote recording medium has an initial writing mode in which reading of the medium cannot occur, a reading mode in which writing of the medium cannot occur, and means for switching irreversibly from said initial writing mode to said reading mode.

7. A device according to claim 6, wherein said write-once vote recording medium is a removable fuse bay cartridge device.

8. A device according to claim 7, wherein: said fuse bay cartridge device further comprises: a write-once array of e-fuse elements; and mode control means for switching said fuse bay cartridge device from an initial writing mode to a reading mode; wherein: when in said writing mode, e-fuse elements can be written, but not read; when in said reading mode, e-fuse elements can be read, but not written; when said fuse bay cartridge device is switched from said writing mode to said reading mode, it cannot be switched back to said writing mode.

9. A device according to claim 6, wherein said fuse strings are encrypted.

10. A device according to claim 9, wherein at least part of said encryption is accomplished according to a Device ID stored in said vote recording medium.

11. A system for electronic voting, comprising:
- a vote-recording device and a vote auditing/tabulating device;
- said vote recording device including:
  - a user interface;
  - poll office access control means;
  - voter access control means; and
  - means for receiving a write-once fuse bay cartridge; said vote auditing/tabulating device including:
  - a user interface;
  - audit access control means; and
  - means for receiving the write-once fuse bay cartridge;
- wherein:
  - said fuse bay cartridge has an initial writing mode in which the cartridge can be written but cannot be read, and a reading mode in which the cartridge can be read, but the cartridge's writing capability becomes permanently disabled such that once switched into the reading mode the cartridge cannot be switched back into the writing mode.

12. A system according to claim 11, wherein said write-once fuse bay cartridge is an e-fuse device.

13. A system according to claim 12, further comprising a unique device ID stored in said e-fuse device.

14. A system according to claim 13, wherein said e-fuse device further comprises write confirmation means for verifying successful writing of said e-fuse device.

15. A system according to claim 11, wherein said write-once fuse bay cartridge is an anti-fuse device.

* * * * *